US007383800B2

(12) United States Patent
Kawakami et al.

(10) Patent No.: US 7,383,800 B2
(45) Date of Patent: Jun. 10, 2008

(54) ASSEMBLY FOR ACTUATING APPARATUS

(75) Inventors: Shigeru Kawakami, Kanagawa (JP); Takashi Ono, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/446,143

(22) Filed: Jun. 5, 2006

(65) Prior Publication Data

US 2006/0283413 A1 Dec. 21, 2006

(30) Foreign Application Priority Data

Jun. 21, 2005 (JP) ..... 2005-180036

(51) Int. Cl.
*F01L 1/34* (2006.01)

(52) U.S. Cl. ..... 123/90.16; 123/90.15; 701/105; 74/89.23

(58) Field of Classification Search ..... 123/90.15, 123/90.16, 90.31, 90.17; 701/105; 74/89.23
See application file for complete search history.

(56) References Cited

U.S. PATENT DOCUMENTS

2005/0199083 A1* 9/2005 Meggiolan ..... 74/473.12

FOREIGN PATENT DOCUMENTS

JP 2004-76824 A 3/2004

* cited by examiner

*Primary Examiner*—Zelalem Eshete
(74) *Attorney, Agent, or Firm*—Foley & Lardner LLP

(57) ABSTRACT

A rotary shaft is formed with an external screw thread; a movable nut is engaged with the rotary shaft, and arranged to move axially in accordance with rotation of the rotary shaft; and a link member is swingably connected with the movable nut to transmit motion from the movable nut. The link member includes first and second side portions and a connecting portion connecting the first and second side portions and forming a depressed portion in which the rotary shaft is received when the link member is in a predetermined leaning posture.

22 Claims, 11 Drawing Sheets

ASSEMBLY FOR ACTUATING APPARATUS

BACKGROUND OF THE INVENTION

The present invention relates to an apparatus such as an actuating apparatus, or an assembly or subassembly of an actuating apparatus. More specifically, the present invention relates to a mechanism which can be used for a variable valve actuating apparatus for controlling an intake or exhaust valve lift quantity or a valve operating angle of an internal combustion engine in accordance with an engine operating condition.

A Japanese patent application publication JP 2004-076824 shows an actuator device usable for a variable valve actuating system for an internal combustion engine. This actuating device includes a ball screw shaft, a ball nut and a link member which includes a bifurcated first end portion swingably connected with the ball nut on both sides at diagonally opposite positions, and a second end portion not bifurcated.

SUMMARY OF THE INVENTION

In the actuating device of this Japanese patent document, the swing motion of the link member is limited since the bifurcated portion of the link member abuts on the ball screw shaft, and thereby limits further swing motion. Therefore, the link member could limit the control width of the variable valve actuating system. Moreover, the subassembly of the ball screw shaft, the ball nut and the link member is bulky and cumbersome in assembly operation because the second end portion of the link member is swingable radially outwards.

According to one aspect of the present invention, an apparatus comprises: a rotary shaft formed with an external screw thread; a movable nut engaged with the rotary shaft, and arranged to move axially in accordance with rotation of the rotary shaft; and a link member swingably connected with the movable nut to transmit motion from the movable nut. The link member includes first and second side portions and a connecting portion connecting the first and second side portions and forming a depressed portion in which the rotary shaft is received when the link member is in a predetermined posture.

According to another aspect of the invention, a production method comprises: preparing a link member including first and second side portions and a connecting portion connecting the first and second side portions and forming a depressed portion; preparing a subassembly including a rotary shaft formed with an external screw thread, a movable nut mounted on the rotary shaft, and arranged to move axially in accordance with rotation of the rotary shaft, and the link member swingably connected with the movable nut; and inserting the subassembly in a compact state in which the link member is inclined to a posture in which the rotary shaft is received in the depressed portion, into a housing from an open end.

DETAILED DESCRIPTION OF THE INVENTION

FIGS. 1~11 show an actuating system according one embodiment of the present invention. In this embodiment, the actuating system is a variable valve actuating system for an internal combustion engine. In an illustrated example, the engine is a V-type 6-cylinder engine having two banks, and the variable valve actuating system is provided for one bank of three cylinders on the intake side.

Figure 8:
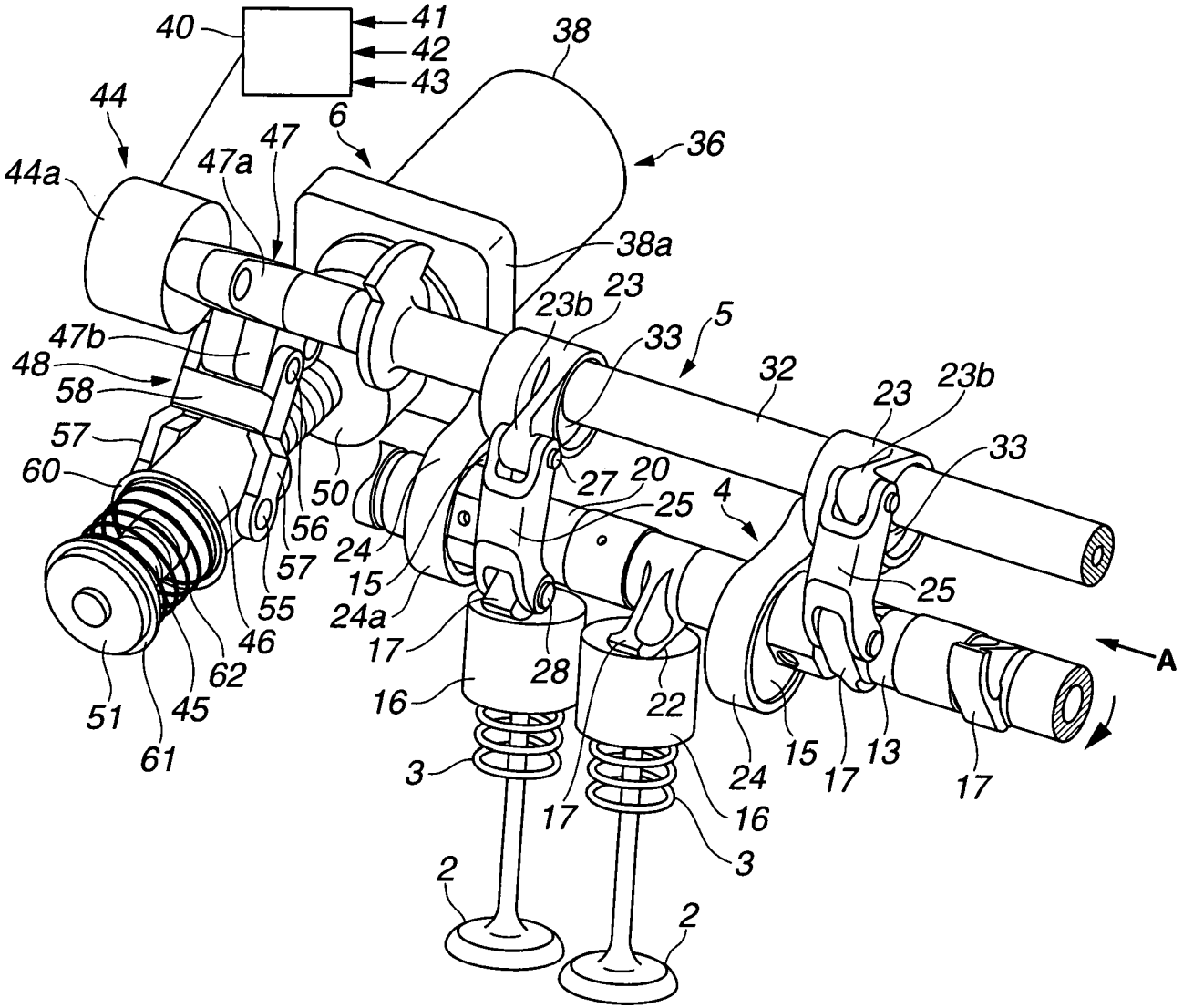
FIG. 8 is a perspective view showing the actuating system of the embodiment which is a variable valve actuating system.

As shown in FIGS. 8~10, the valve actuating system or apparatus includes a pair of intake valves 2 which are supported slidably through valve guides in a cylinder head 1 and which are biased by respective valve springs 3 in the valve closing direction; a variable valve actuating mechanism 4 arranged to control a valve lift (quantity) of each intake valve 2; a control mechanism 5 arranged to control an operating position of the actuating mechanism 4; and a drive mechanism 6 arranged to rotate the control mechanism 5.

Actuating mechanism 4 includes at least a hollow drive shaft 13 which is rotatably supported by bearings 14 on an upper part of cylinder head 1; a drive cam 15 which is an eccentric rotary cam fixedly mounted on drive shaft 13 by press fitting in this example; a pair of swing cams 17 which are swingably mounted on drive shaft 13, and arranged to open the intake valves 2, respectively, by sliding on upper surfaces of valve lifters 16 provided in the upper ends of intake valves 2; and a linkage or motion transmitting mechanism arranged to transmit rotation of drive cam 15 to swing cams 17 for swing motion.

Drive shaft 13 extends in the longitudinal (front and rear) direction of the engine, and receives rotation from a crankshaft of the engine through a rotation transmitting mechanism which, in this example, is a chain drive including a follower sprocket provided on one end of drive shaft 13, a driving sprocket provided on the crankshaft, and a timing chain. When driven by the crankshaft, the drive shaft 13 rotates in the clockwise direction as shown by an arrow in FIG. 8.

Figure 9A:
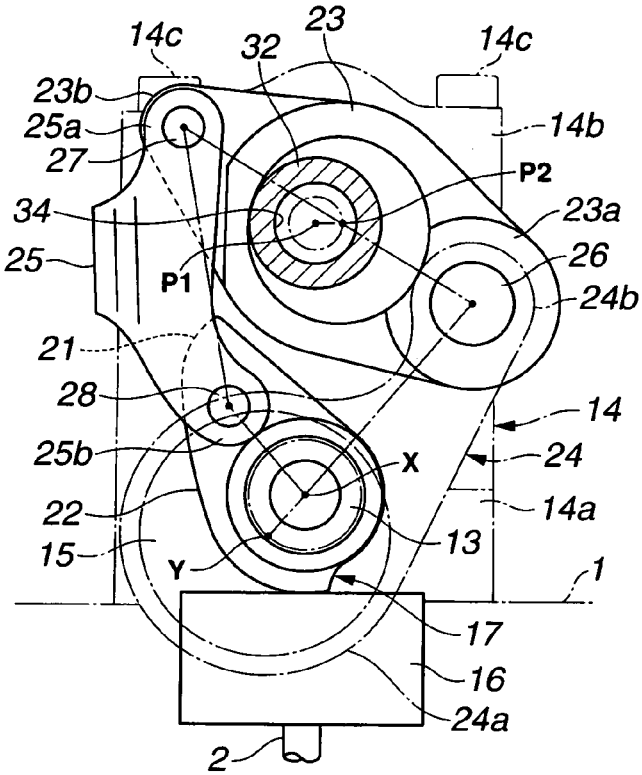
FIGS. 9A and 9B are views of a variable valve actuating mechanism in the actuating system of FIG. 8 as viewed from a direction shown by an arrow A in FIG. 8 to illustrate a valve closing operation (FIG. 9A) and a valve opening operation (FIG. 9B) in the minimum lift control state.

As shown in FIG. 9A, each bearing 14 includes at least a main bracket 14*a* provided in the upper part of cylinder head 1 and arranged to support the upper part of driven shaft 13; and a secondary bracket 14*b* provided on the top of the main bracket 14*a* and arranged to support a control shaft 32 rotatably. Brackets 14*a* and 14*b* are joined together from above by a pair of bolts 14*c*.

Drive cam 15 is shaped like a ring, and composed of an annular cam portion and a tubular portion projecting integrally from the cam portion. Drive cam 15 has a hole passing through drive cam 15 axially. An axis Y of the cam portion of drive cam 15 is offset in a radial direction from the axis X of drive shaft 13 by a predetermined distance.

Swing cams 17 are both shaped identically like a raindrop, and formed integrally at both ends of an annular camshaft 20. The cam shaft 20 is hollow and rotatably mounted on drive shaft 13. Each swing cam 17 includes a cam nose 21; a pin hole formed in the cam nose 21, and a cam surface 22 formed on the lower surface of the swing cam 17. Cam surface 22 includes a base circle surface region on the cam shaft's side, a ramp surface region extending like a circular arc from the base circle surface region toward the cam nose 21, and a lift surface region extending from the ramp surface region toward an apex of the cam nose to provide a greatest lift. The cam surface 22 abuts on the top surface of the corresponding valve lifter 16 at a predetermined position, and the contact point of the cam surface 22 shifts among the base circle surface region, ramp surface region and lift surface region in dependence on the swing position of the swing cam 17.

The above-mentioned linkage or transmitting mechanism includes a rocker arm 23 disposed above drive shaft 13; a link arm 24 connecting a first end portion 23*a* of the rocker arm 23 with drive cam 15; and a link rod 25 connecting a second end portion 23*b* of rocker arm 23 with one swing cam 17.

Rocker arm 23 includes a tubular central base portion formed with a support hole, and rotatably mounted on a control cam 33. The first end portion 23*a* projects from an outer end of the central base portion, and includes a pin hole passing through rocker arm 23 and receiving a pin 26. The second end portion 23*b* projects from an inner end of the central base portion and includes a pin hole receiving a pin 27 connecting the second end portion 23*b* of rocker arm 23 with one end of the link rod 25.

Link arm 24 includes a relatively large annular base portion 24*a* and a projection 24*b* projecting outward from the base portion 24*a*. Base portion 24*a* is formed with a center hole 24*c* in which the cam portion of the drive cam 15 is rotatably fit. The projection 24*b* is formed with a pin hole passing through the projection 24*b* and receiving the pin 26 rotatably.

Link rod 25 has such a bent shape that a recess is formed on the rocker arm's side. A first end 25*a* of link rod 25 is connected with the second end 23*b* of rocker arm 23 by the pin 27. A second end 25*b* of link rod 25 is connected with the cam nose 21 of swing cam 17 by the pin 28. Each of the pins 27 and 28 is received rotatably in the corresponding pin hole.

A snap ring is provided in one end of each of the pins 26, 27 and 28, to limit the axial movement of link arm 24 or link rod 25.

Control mechanism 19 includes the control shaft 32 rotatably supported by the bearings 14 at a position just above drive shaft 13; and the control cam 33 fixed on control shaft 32 and fit slidably in the support hole of rocker arm 23 to serve as a fulcrum for the swing motion of rocker arm 23.

Control shaft 32 extends in parallel to drive shaft 13 in the longitudinal direction of the engine, and includes a plurality of journal portions each of which is rotatably supported between the main bracket 14*a* and the secondary bracket 14*b* of one of the bearings 14.

Control cam 32 is cylindrical, and the center axis P2 of control cam 32 is offset from the center axis P1 of the control shaft 32 by a predetermined amount.

As shown in FIGS. 2~5, the drive mechanism 6 includes a housing 35 fixed to the rear end of cylinder head 1; a drive source or drive section which includes an electric motor 36 in this example, and which is fixed to one end of the housing 35; and a transmission mechanism (37) which is enclosed in the housing 35 and which is arranged to transmit rotation of the motor 36 to the control shaft 32. In this example, the transmission mechanism is a ball screw transmission mechanism 37 serving as a speed reduction mechanism.

Housing 35 of this example is a single integral member of aluminum alloy material. Housing 35 includes a long inside (axially extending) chamber 35*a* for receiving the ball screw transmission mechanism 37 extending in a direction substantially perpendicular to the axial direction of control shaft 32; and an extension chamber 35*b* projecting or bulging upward from an upper middle portion of the inside chamber 35*a* and receiving an end portion 32*a* of control shaft 32 therein. The long inside chamber 35*a* extends axially from a first end 35*c* which is open in the form of a circular opening, to a second end which is closed by an end wall 35*d* of housing 35.

Electric motor 36 of this example is a proportional type DC motor. An approximately cylindrical motor casing 38 of motor 36 is fixed to the housing 35, and a forward end 38*a* of motor casing 38 closes and seals the first open end 35*c* of inside chamber 35 of housing 35. Motor 36 is sealed, through a drive shaft 36*a*, by a mechanical seal provided inside a hollow cylindrical retainer 39 press fit in the first open end 35*c*. As shown in FIG. 8, electric motor 36 is controlled by a control unit 40 in accordance with an engine operating condition.

Control unit 40 is connected with various sensors to determine, or estimate by calculation, the current engine operating condition, and configured to control motor 36 by supplying a control current to motor 36. In this example, the group of sensors connected with control unit 40 includes at least a crank angle sensor 41, an airflow meter (or sensor) 42, a water temperature (or engine coolant temperature) sensor 43, and a position sensor 44 to sense the rotational or angular position of control shaft 32. In this example, this control shaft sensor 44 includes a potentiometer as explained later.

Ball screw transmission mechanism 37 includes a ball screw shaft 45, a ball nut 46, a connection arm 47 and a link member 48. Ball screw shaft 45 and drive shaft 36*a* of motor 36 are arranged end to end and aligned with each other so that their axes form a substantially straight line. Ball screw shaft 45 serves a rotary shaft or output shaft or screw shaft having an external thread. Ball nut 46 serves as a movable nut mounted on the rotary shaft and arranged to move axially in accordance with the rotation of the rotary shaft. Ball nut 46 is screwed on ball screw shaft 45. Connection arm 47 is connected with one end portion 32*a* of control shaft 32 in the extension chamber 35*b*. Link member 48 connects the connection arm 47 and ball nut 46.

Ball screw shaft 45 is formed with an external single continuous ball circulating groove 49 extending, in the form of a helical thread of a predetermined width, over the outside surface of ball screw shaft 45 excepting both end portions. Ball screw shaft 45 is rotatably supported, in housing 35, at both ends by bearings 50 and 51. Bearing 50 (second bearing) supports an end portion 45*a* of ball screw shaft 45 near the open end 35*c* of inside chamber 35*a*. Bearing 51 supports an opposite end portion 45*b* of ball screw shaft 45 in a small diameter section of chamber 35*a* near the end wall 35*d*. Bearing 50 closer to motor 35 is a double bearing having two axially spaced sets of rolling elements. Bearing 50 is press fit and fixed in the chamber 35*a* from the open end 35*c*. Bearing 51 is press fit and fixed in the small diameter section adjacent to the end wall 35*d*. In this example, the outside diameter of bearing 51 is smaller than the outside diameter of bearing 50.

Ball screw shaft 45 and drive shaft 36*a* of motor 36 are aligned and connected end to end by a coupling member 52 in the form of a hollow cylinder so as to transmit rotation while allowing slight axial movement. In this example, the forward end of end portion 45*a* of ball screw shaft 45 is hexagonal in cross section and this hexagonal end is fit in coupling member 52. Coupling member 52 transmits a rotational driving force from motor 36 to ball screw shaft 45, and allow ball screw shaft 45 to move axially to a limited small extent.

Ball nut 46 is approximately in the form of a hollow cylinder. Ball nut 46 is formed with an internal guide groove 53 designed to hold a plurality of balls 54 in cooperation with the ball circulating groove 49 of ball screw shaft 45 so that balls 54 can roll between the grooves 53 and 49. This guide groove 53 is a single continuous helical thread formed in the inside circumferential surface of ball nut 46. In this example, the ball nut 46 is provided with two deflectors setting ball recirculation paths of balls 54 at two axial positions spaced axially from each other. These deflectors guide the balls to enable recirculation of balls 54 at the two axially spaced positions.

Ball nut 46 is arranged to translate the rotation of ball screw shaft 45 into a linear motion of ball nut 46 and produce an axial force. Ball nut 46 is connected with one end of link member 48 by fulcrum pins 55 which are rotatably supported by ball nut 46 at a middle position between both axial ends of ball nut 46. In this example, pins 55 are arranged diametrically opposite.

As shown in FIGS. 2~5, connection arm 47 of this example includes an approximately rhombic base portion 47*a* fixedly mounted on the end portion 32*a* of control shaft 32; and a projecting portion 47*b* projecting from the base portion 47*a*. The projecting portion 47*b* is connected rotatably with the other end of link member 48 by a fulcrum pin 56.

As shown in FIGS. 1~5, link member 48 of this example is formed by press forming of plate or sheet material. Link member 48 includes two parallel link portions (or side portions) 57, and a connecting portion 58 connecting the two parallel link portions 57. Each link portion 57 is in the form of a long plate or plate-shaped bar. Each of plate-shaped link portions 57 has upper and lower sides or edges extending longitudinally. Connecting portion 58 connects intermediate or middle portions of the upper sides of link portions 57.

Figure 1A:
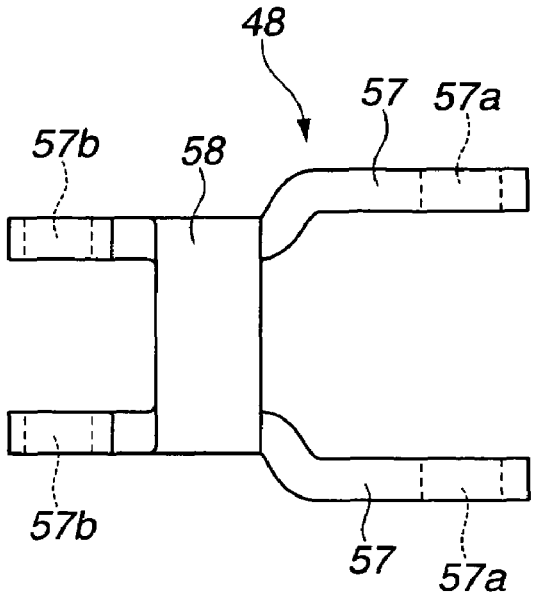
FIGS. 1A, 1B and 1C are plan view, side view and front view showing a link member according to one embodiment of the present invention.

As shown in FIG. 1A, each link portion 57 includes a first segment formed with a pin hole 57*a* and a second segment formed with a pin hole 57*b*. In this example, the first segments of link portions 57 are straight and parallel to each other, and the second segments of link portions 57 are also straight and parallel to each other. As shown in FIG. 1A, the distance between the parallel first segments is greater than the distance between the parallel second segments. Each link portion 57 includes a bent portion between the first and second segments. As shown in FIG. 1A, link member 48 is symmetrical in the manner of bilateral symmetry with respect to an imaginary median plane to which the first and second segments are substantially parallel. Each link portion 57 includes an intermediate portion which is formed between the first and second segments and which is connected by the connecting portion 58 with the intermediate portion of the other of the link portions 57.

Connecting portion 58 has an approximately flat rectangular surface as shown in FIG. 1A, and first and second ends bend downward so as to form an L-shaped edge and joined with the upper sides of the intermediate segments of link portions 57 at the position adjacent to the bent portions. Connecting portion 58 extends laterally and thereby bridges the space between the link portions 57. In each side portion 57, the intermediate segment and the second segment are in the form of a continuous straight segment and the distance between the intermediate segments is equal to the distance between the second segments and smaller than the distance between the first segments.

Figure 1C:
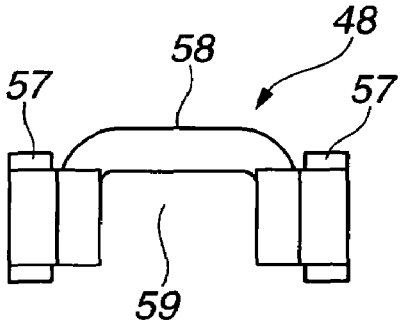
Figure 1B:
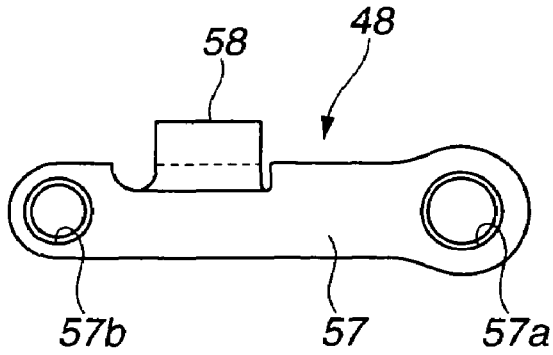

Connecting portion 58 and two intermediate segments of link portions 57 forms an inverted U-shaped portion defining a space or depressed portion 59 as shown in FIG. 1C. A bifurcated portion formed by the parallel first segments projects from the middle connecting portion 58 in a first direction to one side (to the right as viewed in FIG. 1A), and opens in the first direction in the form of a larger two-prong fork, as shown in FIG. 1A. A bifurcated portion formed by the parallel second segments projects from the middle connecting portion 58 in a second direction to the opposite side (to the left as viewed in FIG. 1A), and opens in the second direction in the form of a smaller two-prong fork.

The first segments of link member 48 are swingably connected with ball nut 46 through pins 55 received in the pin holes 57*a*. Ball nut 46 is fit between the first segments of link member 48 and connected with a small clearance. The second segments of link member 48 are swingably connected with the projecting portion 47*b* of connection arm 47 through pin 56. The projecting portion 47*b* of connection arm 47 is fit between the second segments of link member 48 with a small clearance. Pins 55 and 56 are fixed, respectively, in the pin holes 57*a* and pin holes 57*b* by staking. In this way, one end of link member 48 is connected rotatably with ball nut 46, and the other end of link member 48 is connected rotatably with connection arm 47.

Figure 3:
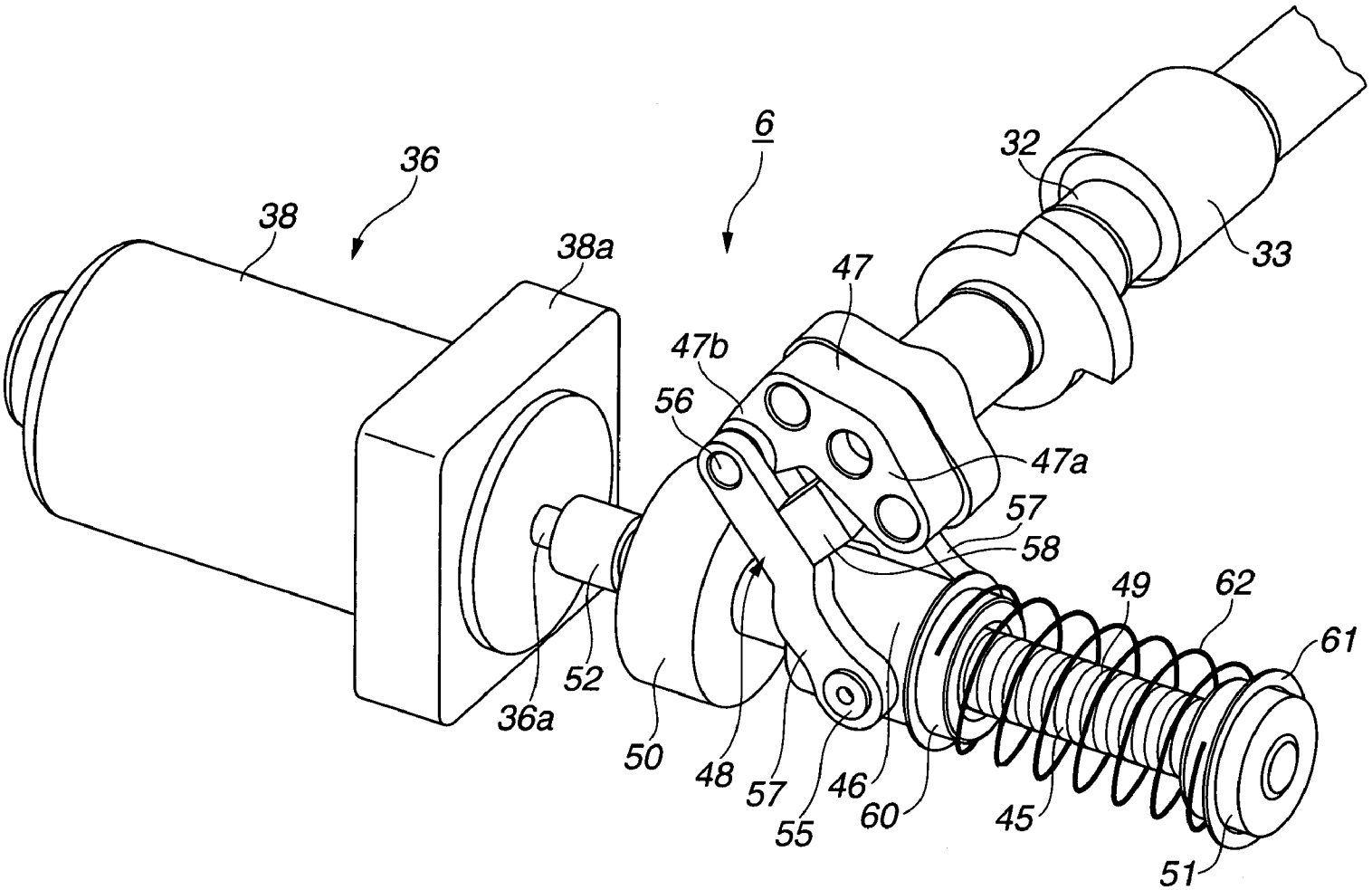
FIG. 3 is a perspective view showing the actuating system according to the embodiment in the minimum lift control state.
Figure 5:
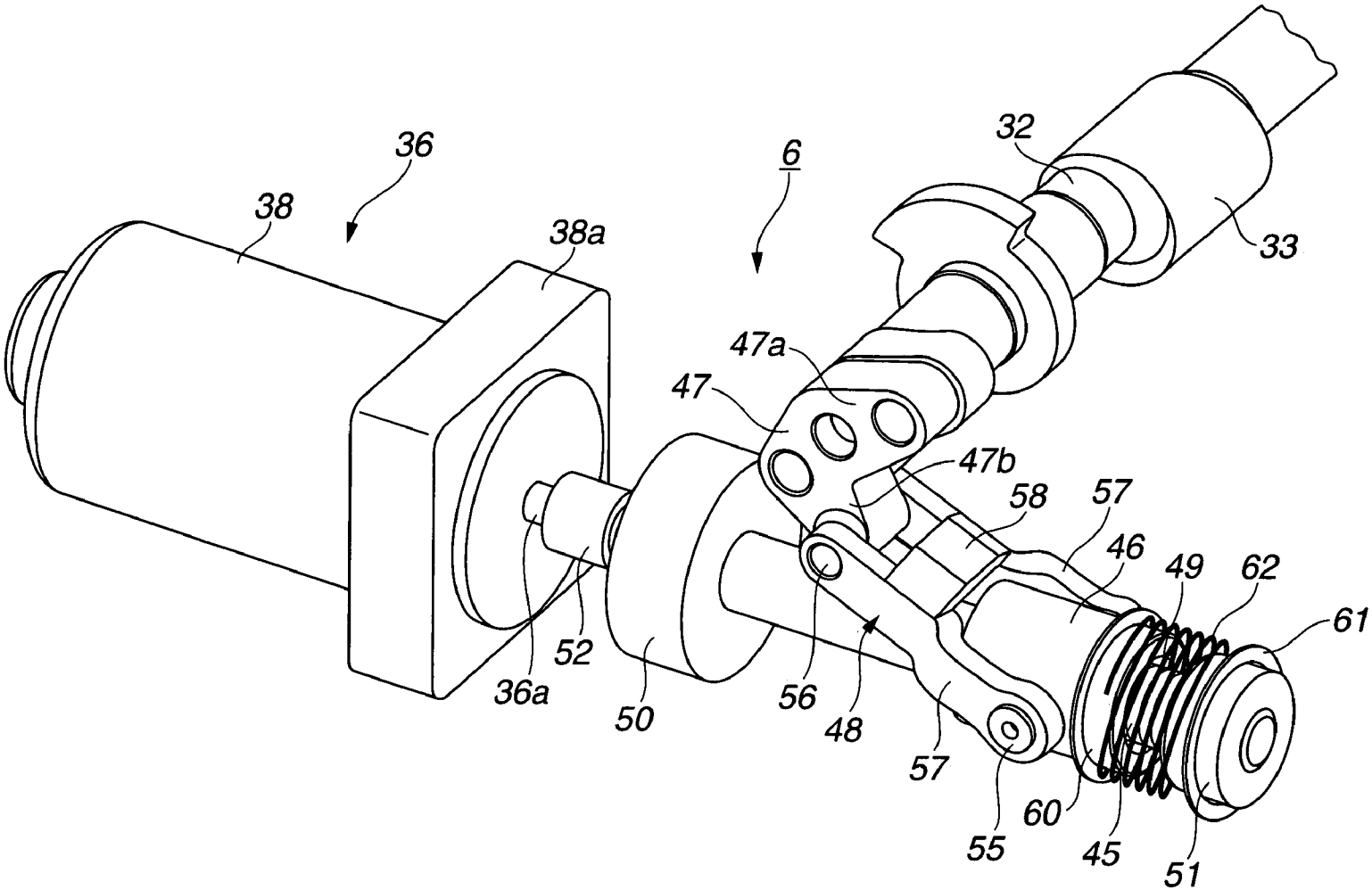
FIG. 5 is a perspective view showing the actuating system according to the embodiment in the maximum lift control state.
Figure 7:
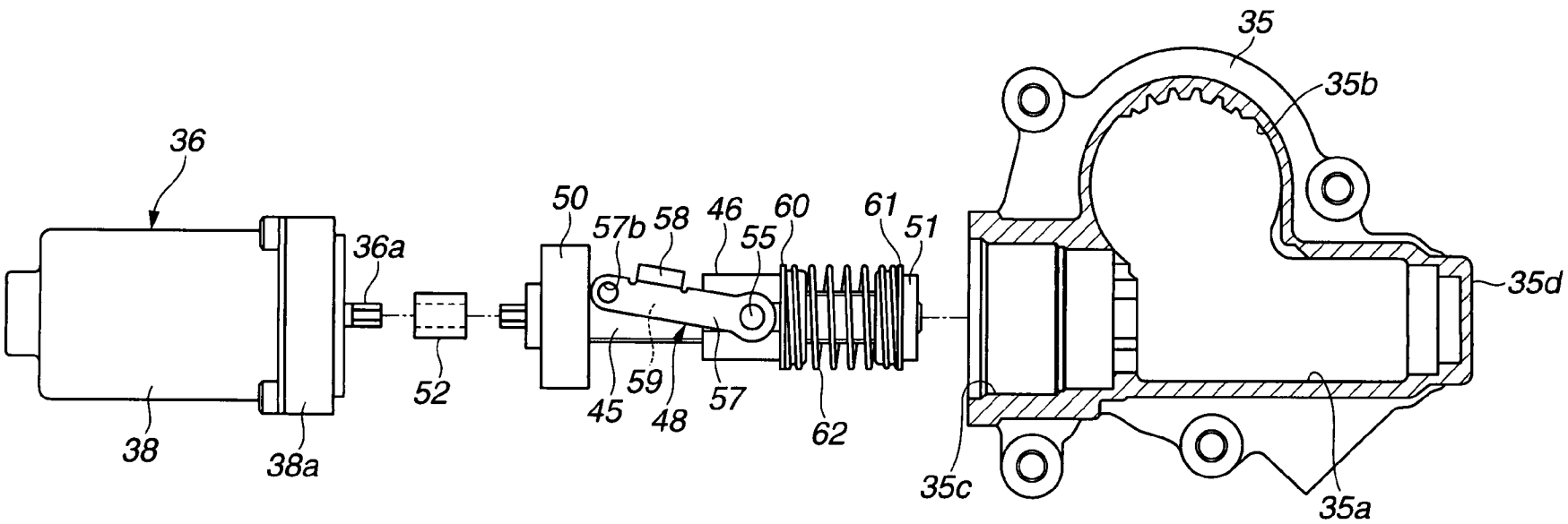
FIG. 7 is an exploded view for illustrating the assembly process of the subassembly in a compact state, the housing and the motor of the actuating system according to the embodiment.

Therefore, link member 47 can incline as shown in FIG. 3 and FIG. 5, in accordance with axial movement of ball nut 46. When link member 47 is at a lowest position closest to a horizontal posture as shown in FIG. 7, the upper part of ball screw shaft 45 is received in the depressed portion 59 of link member 47, and the link member 48 is approximately parallel to the axis of ball screw shaft 45.

A coil spring 62 is disposed around ball screw shaft 45 between first and second spring retainers 60 and 61. Spring retainer 60 is provided at one axial end of ball nut 46. Spring retainer 61 is disposed at a position adjacent to the bearing 51. Coil spring 62 together with spring retainers 60 and 61 can serve as an urging member or bias member for urging the ball nut 46 toward electric motor 36.

Figure 2:
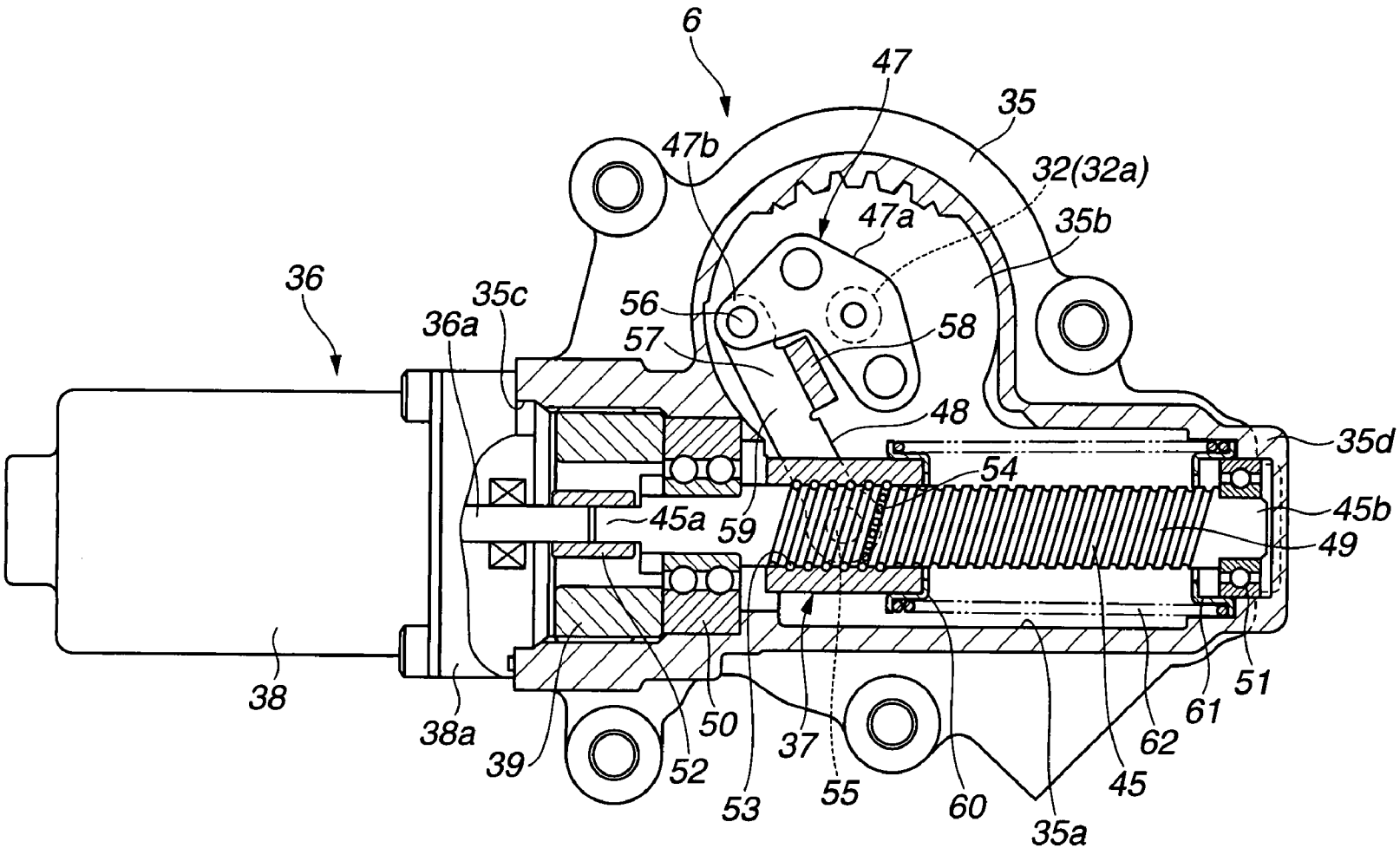
FIG. 2 is a view partly in section for illustrating operation of an actuating system according to the embodiment of the present invention in a minimum lift control state.

The thus-constructed actuating apparatus according to this embodiment is operated as follows: In a low engine speed region including an idling operation, the control unit 40 acts to bring the ball nut 46 to a leftmost position as shown in FIGS. 2 and 3, by sending control current to motor 36 and rotating the ball screw shaft 45 with motor 36. With this rotation of ball screw shaft 45, the balls 54 circulates through the passageway formed between the ball circulation groove 49 and guide groove 53, and the ball nut 46 moves axially to the leftmost position. With this leftward movement of ball nut 46, the control shaft 32 is rotated in the clockwise direction as shown in FIGS. 9A and 9B, by the link member 48 and connection arm 47.

Figure 9B:
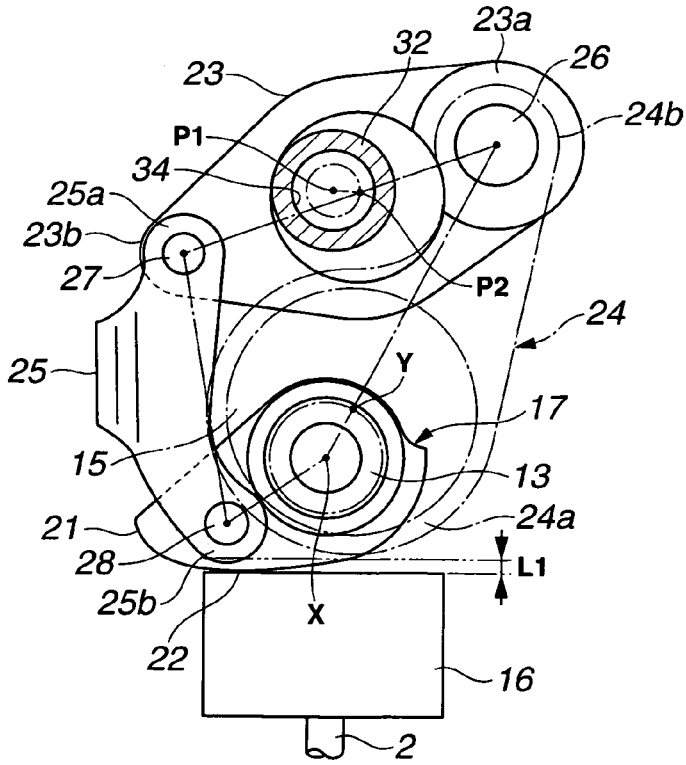

Therefore, control cam 33 rotates about the axis P1 of control shaft 32 so that the axis P2 rotates about the axis P1 to the position shown in FIGS. 9A and 9B. As a result, the pivot point between the second end portion 23*b* of rocker arm 23 and link rod 25 is shifted upwards relative to the drive shaft 13. Therefore, each swing cam 17 is rotated in the clockwise direction, and the cam nose 21 is pulled upwards by link rod 25.

Accordingly, drive cam 15 rotates and pushes up the end 23*a* of rocker arm 23 through link arm 24. Though a movement for valve lift is transmitted through link rod 25 to swing cam 17 and valve lifter 16, the valve lift quantity is decreased sufficiently to a characteristic L2 shown in FIG. 11.

Figure 11:
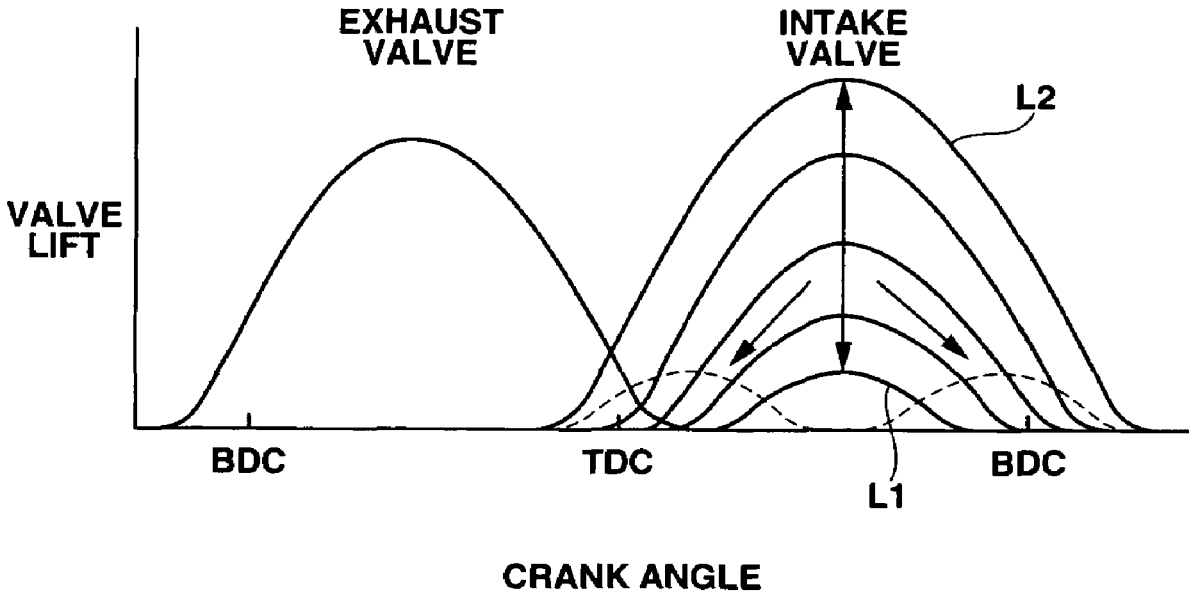
FIG. 11 is a graph showing a valve lift characteristic of each intake valve in the variable valve actuating system according to the embodiment.

Thus, in the low speed region, this variable valve actuating system decreases the valve lift (quantity) to a minimum value L1 as shown in FIG. 11, thereby retards the intake valve opening timing, and decreases the valve overlap. In this way, this system can improve the fuel efficiency and provide stable rotation of the engine.

In a high engine speed region, the control unit 40 drives motor 36 in a reverse rotational direction, and thereby rotates the ball screw shaft 45 in the reverse direction. With this reverse rotation, the ball nut 46 moves through the balls 54 in the axial direction away from motor 36 rightwards to the position shown in FIGS. 4 and 5, from the position shown in FIGS. 2 and 3.

Figure 10A:
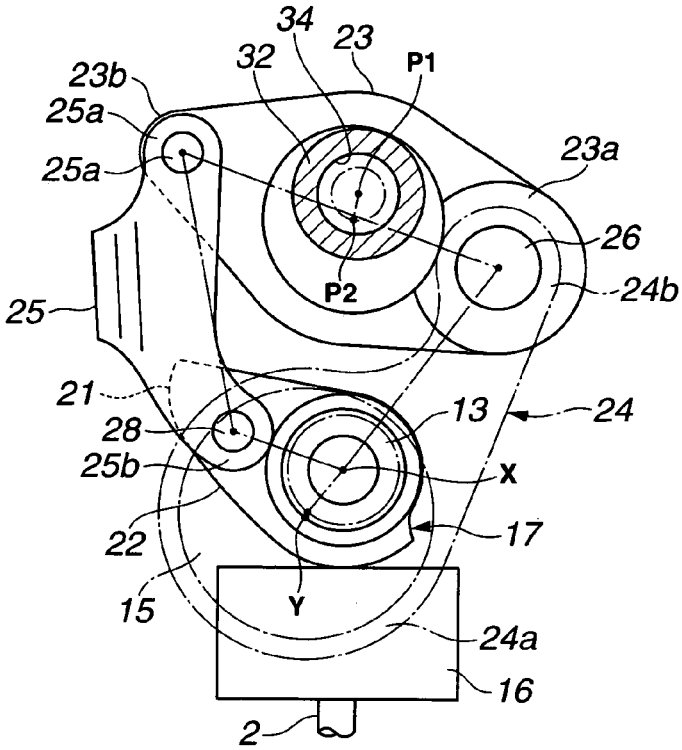
FIGS. 10A and 10B are views of the variable valve actuating mechanism in the actuating system of FIG. 8 as viewed from a direction shown by arrow A in FIG. 8 to illustrate the valve closing operation (FIG. 10A) and the valve opening operation (FIG. 10B) in the maximum lift control state.
Figure 10B:
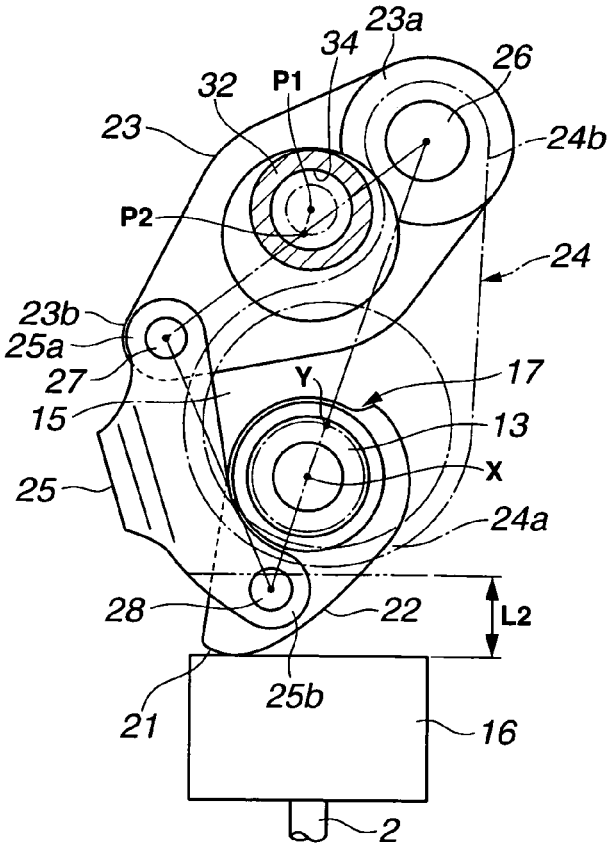

Therefore, control shaft 32 rotates the control cam 33 in the clockwise direction from the position shown in FIGS. 9A and 9B to the position shown in FIGS. 10A and 10B at which the axis P2 is at a lower position closer to drive shaft 13. Rocker arm 23 moves toward the drive shaft 13, and the end 23*b* of rocker arm 23 pushes down the cam nose 21 of rocker cam 17 through link rod 25, and rocker cam 17 rotates in the counterclockwise direction by a predetermined amount.

Accordingly, drive cam 15 rotates and pushes up the end 23*a* of rocker arm 23 through link arm 24. A movement for valve lift is transmitted through link rod 25 to rocker cam 17 and valve lifter 16. In this case, the valve lift quantity is increased.

Thus, in the high speed region, this variable valve actuating system increases the valve lift (quantity) to a maximum value L2 as shown in FIG. 11, thereby advances the intake valve opening timing, and retards the closing timing. In this way, this system can improve the intake charging efficiency and the engine output by advancing the intake valve opening timing and retarding the intake valve closing timing.

The ball screw mechanism or assembly can transmit rotation of ball screw shaft 45 to the ball nut 46 through the circulating balls 54 with a very small friction resistance, so that the ball nut 46 can move smoothly and respond quickly to rotation of ball screw shaft 45. Therefore, this actuating system can improve the response of the valve lift control based on the engine operating condition.

Figure 4:
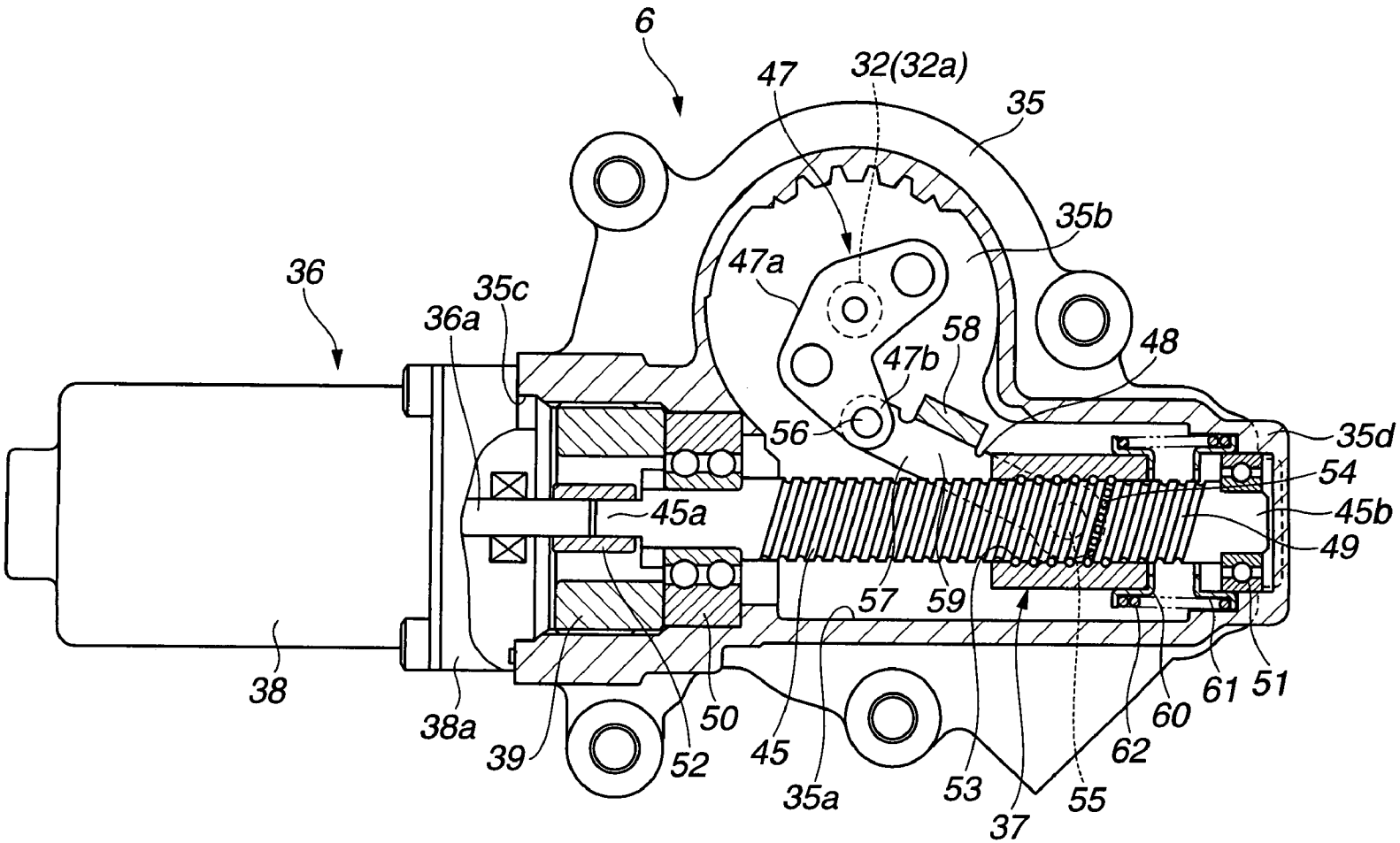
FIG. 4 is a view showing the actuating system according to the embodiment in a maximum lift control state.

When ball nut 46 moves to the maximum extent in the direction as shown in FIGS. 4 and 5, the link member 48 is inclined to a leaning posture in which the upper portion of ball screw shaft 45 enters the U-shaped space 59 of link member 48, and hence the angle of the link member 48 with respect to the axis of ball screw shaft 45 is decreased almost to zero or to a small acute angle, so that the ball nut 46 can move axially to a wider extent. Therefore, this actuating system can increase the range of the angular displacement of control shaft 32, and increase the control width of valve lift of valve actuating mechanism 4.

Coil spring 62 applies a bias force to push the ball nut 46 axially toward motor 36, and thereby reduces backlash between guide groove 53 and ball recirculation groove 49. Therefore, this arrangement can reduce slapping noises produced between the teeth of guide groove 53 and ball recirculation groove 49 during movement of ball nut 46 and specifically during operation of translating rotation to linear motion.

Ball screw shaft 45 and ball nut 46 are assembled into chamber 35*a* of housing 35 from the open end 35*c* in the following manner.

Figure 6:
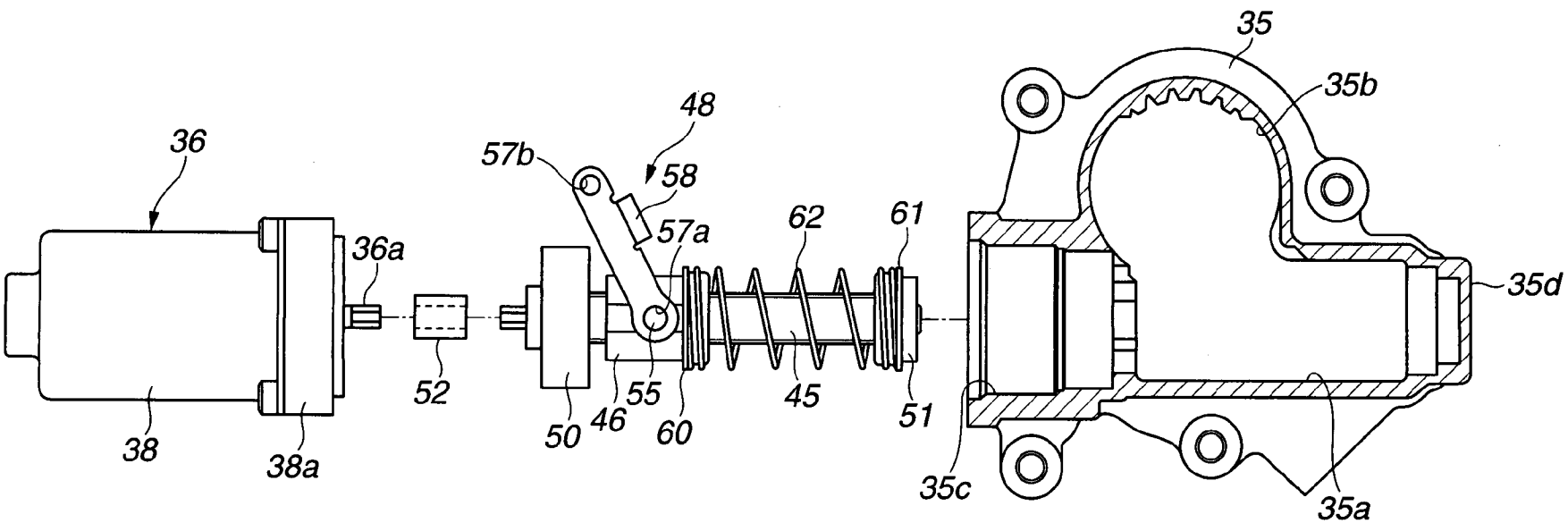
FIG. 6 is an exploded view showing a subassembly of a ball screw shaft, a ball nut and a link member in an expanded state, a housing and a motor of the actuating system according to the embodiment to illustrate an assembly process.

As shown in FIG. 6, ball nut 46 is screwed onto ball screw shaft 45. With connecting portion 58 being positioned preliminarily at an upper position, the link member 48 is connected swingably with ball nut 46 by inserting pins 55 projecting from both sides of ball nut 46, into pin holes 57*a* of link member 48.

Then, the bearing 51 is fixedly mounted on the forward end of ball screw shaft 45. During the process of this operation, coil spring 62 is disposed through spring retainers 60 and 61 between ball bearing 51 and ball nut 46. Furthermore, ball bearing 50 is fixedly mounted on the motor's side end of ball screw shaft 45.

Thereafter, as shown in FIG. 7, the ball nut 46 is rotated and thereby moved axially against the spring force of coil spring 62 toward the ball bearing 51. At the same time, link member 48 is inclined to the leaning posture in which the ball screw shaft 45 is received in the U-shaped portion 59 of link member 48, and the longitudinal direction of link member 48 is approximately parallel to the axis of ball screw shaft 45. In this state, the other end of link member 48 resiliently abuts against one side of the ball bearing 50 by the spring force of coil spring 62.

Thus, the ball screw shaft 45, ball bearings 50 and 51, ball nut 46, link member 48, coil spring 62 and spring retainers 60 and 61 of ball screw mechanism 37 are assembled into a compact subassembly.

Then, this subassembly in the compact state as shown in FIG. 7 is inserted axially from the open end 35*c* into the axially extending chamber 35*a* in housing 35 and installed in housing 35.

Then, drive shaft 36*a* of motor 36 is connected through coupling member 52 with the end of ball screw shaft 45, and the forward end 38*a* of motor casing 38 is fixed by bolts to the surrounding portion of the open end 35*c*. In this way, all the components are placed inside the housing 35.

Then, in housing 35, the connection arm 47 is fixed to the end 32*a* of control shaft 32 inserted in the projecting chamber 35*b*, the end of link member 48 is pulled upward, and the projecting portion 47*b* of connection arm 47 is connected rotatably with the end of link member 48 by pin 56 inserted through pin holes 57*b*. In this way, the assembly process is made easier.

In this embodiment, link member 48 can be inclined to the posture in which link member 48 is almost parallel to the ball screw shaft 45. Therefore, the subassembly is compact and its cross sectional size is reduced. The subassembly of ball screw shaft 45, ball nut 46, and link member 47 can be readily inserted into housing 35 from the open end 35*c*.

In the subassembly in the compact state of FIG. 7, link member 48 is held in the leaning posture and held fixed in position temporarily by the spring force of coil spring 62 causing the upper end of link member 48 to abut against bearing 50. Therefore, the subassembly is easy to handle and the operation of inserting the subassembly into housing 35 becomes easier and smooth.

In this example, the cross sectional size of the subassembly of ball screw shaft 45, ball nut 46, link member 48, bearings 50 and 51 and spring 62 is greatest at the bearing 50, and the link member 48 is entirely within an imaginary cylinder defined by the outside circumference of an outer race of the bearing 50. Therefore, link member 48 doest not projects radially outwards beyond the bearing 50, and it is possible to insert the link member 48 connected with ball nut 46 into the chamber 35*a* through a cylindrical opening in which the bearing 50 is fit tightly.

In the assembled state, coil spring 62 acts to absorb the backlash between the externally threaded portion 49 of ball screw shaft 45 and the guide groove 53 of ball nut 46 by pushing ball nut 46 axially toward motor 36, and thereby prevent unsmooth movement between shaft 45 and nut 46.

Link member 48 can be formed by press forming of sheet metal or plate metal. Therefore, the operation of producing link member 48 is easier and the manufacturing cost is low.

It is optional to form the link member 48 in various shapes. For example, the connecting portion 58 of link member 48 may be shaped so that the cross section has an inverted U-shaped form or an inverted V-shaped form. The control shaft 32 may be used for various actuating mechanisms other than the variable valve mechanism 4 for varying the valve lift quantity. It is possible to dispose the motor 36 at various different positions in dependence on the layout in an engine compartment of a vehicle. Instead of the electric motor, the drive section may employ a hydraulic motor or a hydraulic cylinder actuator. Moreover, it is possible to employ various ball screw assemblies such as a deflector type forming a ball recirculation path with a deflector or a tube type forming a ball recirculation path with a tube. The rotary shaft (or screw shaft)(45) and the movable nut (46) may be bolt and nut engaging with each other directly (without the intervention of balls). The variable valve actuating mechanism according to the embodiment of the present invention can be applied to engine exhaust valves instead of intake valves or both of the intake valve's side and the exhaust valve's side.

This application is based on a prior Japanese Patent Application No. 2005-180036 filed on Jun. 21, 2005. The entire contents of this Japanese Patent Application No. 2005-180036 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An apparatus comprising:

a rotary shaft formed with an external screw thread;

a movable nut engaged with the rotary shaft, and arranged to move axially in accordance with rotation of the rotary shaft; and a link member swingably connected with the movable nut to transmit motion from the movable nut, the link member including first and second side portions and a connecting portion connecting the first and second side portions and forming a depressed portion in which the rotary shaft is received when the link member is in a predetermined posture, wherein the apparatus further comprises a housing in which the rotary shaft is rotatably supported, wherein the housing includes an axially extending chamber receiving the rotary shaft and extending in an axial direction of the rotary shaft, from a closed chamber end closed by a wall of the housing, to an open chamber end which is so sized as to insert a subassembly of the rotary shaft, the movable nut and the link member into the axially extending chamber from the open chamber end.

2. An apparatus as claimed in claim 1, wherein the connecting portion and the first and second side portions of the link member form a U-shaped portion which defines the depressed portion, and which straddles the rotary shaft when the link member is in the predetermined posture.

3. An apparatus as claimed in claim 2, wherein the first and second side portions of the link member extend from the U-shaped portion, to respective end portions which are swingably connected with the movable nut on both sides of the movable nut.

4. An apparatus as claimed in claim 2, wherein each of the first and second side portions of the link member is a plate-shaped bar whose width extends downward from the connecting portion to form the U-shaped portion.

5. An apparatus as claimed in claim 4, wherein each of the first and second side portions of the link member includes a first segment extending in a first direction from the U-shaped portion to a first end which is connected swingably with the movable nut on one side of the movable nut, an intermediate segment connected, by the connecting portion, with the intermediate segment of the other of the side portions to form the U-shaped portion, and a second segment extending in a second direction opposite to the first direction from the U-shaped portion.

6. An apparatus as claimed in claim 5, wherein a distance between the first segments of the first and second side portions is greater than a distance between the intermediate segments connected together by the connecting portion.

7. An actuating apparatus as claimed in claim 1, wherein the link member is a metallic member formed by press forming.

8. An actuating apparatus as claimed in claim 1, wherein the link member is approximately parallel to the rotary shaft when the link member is in the predetermined posture in which the rotary shaft is received in the depressed portion of the link member.

9. An apparatus as claimed in claim 1 wherein the rotary shaft is a ball screw shaft, and the movable nut is a ball nut.

10. An apparatus as claimed in claim 1, wherein the apparatus further comprises a drive section to rotate the rotary shaft.

11. An apparatus as claimed in claim 10, wherein the drive section is fixed to the housing; and wherein the drive section includes a drive shaft aligned with the rotary shaft and connected end to end with the rotary shaft.

12. An apparatus as claimed in claim 11, wherein the drive section is fixed to the housing so as to close an opening of the housing from which the rotary shaft is inserted into the housing; and wherein the drive section comprises a motor.

13. An apparatus as claimed in claim 10, wherein the apparatus further comprises an actuating section and the link member is connected swingably at one end with the movable nut, and further connected swingably at the other end with the actuating section to transmit motion from the movable nut to the actuating section.

14. An apparatus as claimed in claim 13, wherein the actuating section includes a variable valve actuating section arranged to vary an engine valve lift quantity of an internal combustion engine.

15. An apparatus as claimed in claim 14, wherein the variable valve actuating section comprises:

a drive shaft adapted to be driven by the engine;

a drive cam fixedly mounted on the drive shaft;

a swing cam to operate an engine valve;

a linkage to transmit motion from the drive cam to the swing cam and thereby to cause the swing cam to swing to operate the engine valve; and a control mechanism to alter an operating point of the linkage, the link member being connected with the control mechanism.

16. An apparatus as claimed in claim 15, wherein the control mechanism comprises:

a control shaft extending along the drive shaft; and a control cam fixedly mounted on the control shaft;

wherein the linkage comprises:

a rocker arm mounted swingably on the control cam;

a link arm connecting the drive cam with a first end of the rocker arm; and a link rod connecting a second end of the rocker arm with the swing cam; and wherein the link member is connected with the control shaft and arranged to alter an angular position of the control shaft.

17. An apparatus as claimed in claim 15, wherein the apparatus further comprises a sensor section to sense an engine operating condition, and a control unit to control the drive section in accordance with the engine operating condition.

18. An apparatus comprising:

a rotary shaft formed with an external screw thread;

a movable nut engaged with the rotary shaft, and arranged to move axially in accordance with rotation of the rotary shaft; and a link member swingably connected with the movable nut to transmit motion from the movable nut, the link member including first and second side portions and a connecting portion connecting the first and second side portions and forming a depressed portion in which the rotary shaft is received when the link member is in a predetermined posture, wherein the connecting portion and the first and second side portions of the link member form a U-shaped portion which defines the depressed portion, and which straddles the rotary shaft when the link member is in the predetermined posture, wherein the first and second side portions of the link member extend from the U-shaped portion, to respective end portions which are swingably connected with the movable nut on both sides of the movable nut, wherein the rotary shaft, the movable nut and the link member are components of a subassembly, and the subassembly further comprises:

first and second bearings fixedly mounted on the rotary shaft; and a bias member disposed between the rotary shaft and the movable nut, and arranged to urge the movable nut axially toward the second bearing; and wherein the link member extends from a first link end swingably connected with the movable nut to a second link end which stands free when the subassembly is in an expanded state, and which abuts against the second bearing when the subassembly is in a compact state in which the link member is held stationary in the predetermined posture by being pushed toward the second bearing through the movable nut by the bias member so that the subassembly is compact and easy to handle.

19. An apparatus as claimed in claim 18, wherein when the subassembly is in the compact state, the link member is folded so that the link member is located entirely within an imaginary cylinder which is coaxial with the second bearing and smaller in diameter than an outside diameter of the second bearing.

20. An apparatus as claimed in claim 18, wherein the apparatus further comprises a housing in which the rotary shaft is rotatably supported.

21. An apparatus comprising:

a rotary shaft formed with an external screw thread;

a movable nut engaged with the rotary shaft, and arranged to move axially in accordance with rotation of the rotary shaft; and a link member swingably connected with the movable nut to transmit motion from the movable nut, the link member including first and second side portions and a connecting portion connecting the first and second side portions and forming a depressed portion in which the rotary shaft is received when the link member is in a predetermined posture, wherein the apparatus further comprises a housing in which the rotary shaft is rotatably supported, wherein the housing includes an axially extending chamber receiving the rotary shaft and extending in an axial direction of the rotary shaft, from a closed chamber end closed by a wall of the housing, to an open chamber end which is so sized as to insert a subassembly of the rotary shaft, the movable nut and the link member into the axially extending chamber from the open chamber end, wherein the apparatus comprises:

the housing including the axially extending chamber containing the rotary shaft and an extension chamber bulging radially from the axially extending chamber; and the subassembly which comprises:

the rotary shaft;

first and second bearings fixedly mounted on the rotary shaft and arranged to support the rotary shaft rotatably in the housing;

the movable nut mounted on the rotary shaft axially between the first and second bearings;

a bias member disposed between the rotary shaft and the movable nut, mounted on the rotary shaft axially between the first bearing and the movable nut, and arranged to urge the movable nut axially toward the second bearing; and the link member including a first end swingably connected with the movable nut and a second end which enters the extension chamber of the housing when the link member is in a predetermined second posture.

22. A production method comprising:

preparing a link member including first and second side portions and a connecting portion connecting the first and second side portions and forming a depressed portion;

preparing a subassembly including a rotary shaft formed with an external screw thread, a movable nut mounted on the rotary shaft, and arranged to move axially in accordance with rotation of the rotary shaft, and the link member swingably connected with the movable nut; and inserting the subassembly in a compact state in which the link member is inclined to a posture in which the rotary shaft is received in the depressed portion, into a housing from an open end, wherein the subassembly in the compact state is inserted, in an axial direction of the rotary shaft, into an axially extending inside chamber of the housing from the open end.

* * * * *